US005375519A

United States Patent [19]

Junghans et al.

[11] Patent Number: 5,375,519

[45] Date of Patent: Dec. 27, 1994

[54] DEVICE FOR RECEIVING ROLLERS

[75] Inventors: Rudi Junghans, Wilhelmsfeld; Lothar Stein, Sandhausen, both of Germany

[73] Assignee: Heidelberger Druckmaschinen AG, Heidelberg, Germany

[21] Appl. No.: 65,661

[22] Filed: May 21, 1993

[30] Foreign Application Priority Data

May 21, 1992 [DE] Germany ..... 4216781

[51] Int. Cl.[5] ..... B41F 31/00

[52] U.S. Cl. ..... 101/349; 384/259

[58] Field of Search ..... 101/216, 349, 348, 350, 101/351, 352, 204, 205, 206, 209, 139, 140, 148, 182, 247; 118/262; 100/168; 384/259

[56] References Cited

U.S. PATENT DOCUMENTS

| | | | |
|---|---|---|---|
| 1,418,562 | 6/1922 | Hasse | 101/349 |
| 1,511,783 | 10/1924 | Sproull | 101/349 |
| 2,751,843 | 6/1956 | Faeber | 101/349 |
| 2,892,399 | 6/1959 | Chase | 101/349 |
| 3,167,010 | 1/1965 | Worthington et al. | 101/349 |
| 4,144,811 | 3/1979 | Barnett | 101/349 |

FOREIGN PATENT DOCUMENTS

| | | |
|---|---|---|
| 3342853 | 7/1985 | Germany . |
| 2132944 | 7/1984 | United Kingdom . |

*Primary Examiner*—Ren Yan

*Attorney, Agent, or Firm*—Herbert L. Lerner; Laurence A. Greenberg

[57] ABSTRACT

A device for receiving therein a prestressed roller journal, the device being provided in a printing unit of a rotary printing press, includes a screw-in element having a prestressed pressure element movably guided therein for adjusting to a contact width of a roller, a bearing member carrying the screw-in element and being adjustable between a vertical installation position thereof and at least one installation position deviating from the vertical installation position, the bearing member being formed with a pair of guide cams disposed opposite one another for automatically orienting the roller in the vertical installation position, one of the guide cams of the pair thereof being disposed so as to carry the weight of the roller in the at least one installation position of the bearing member deviating from the vertical installation position.

10 Claims, 3 Drawing Sheets

DEVICE FOR RECEIVING ROLLERS

BACKGROUND OF THE INVENTION

1. Field of the Invention

The invention relates to a device for receiving rollers, especially in inking units of rotary printing presses.

2. Description of the Related Art

An inking unit for rotary printing presses has become known heretofore from the state of the art, as exemplified by the German Published Patent Document 33 42 852 C2, which is convertible from newspaper printing to job or commercial printing by the installation of supplemental components. For this purpose, bearing plates or brackets are provided wherein transfer rollers are received. An adjustment of a roller gap between one of the transfer rollers and an applicator roller is effected via a thumbscrew and is included in the individual discretionary estimates made by the pressman.

A device is furthermore known from U.S. Pat. No. 3,167,010 wherein adjustable roller bearings for ink applicator rollers and transfer rollers are disclosed. Slide rings are fastened in side walls so that bearing members can be shifted by twisting an adjustment screw in order to vary the contact force in the contact zone. The amount or size of the contact force is indicated by the compression path of a spring or a spring set or package. After the adjustment position for generating a defined contact force has been determined, the bearing member is fastened in the determined position. No provision is made in this heretofore known device for an automatic adjustment of the contact zone to parameters varying during the operation of the printing press.

SUMMARY OF THE INVENTION

It is accordingly an object of the invention to provide a device for receiving rollers which, in furtherance of the state of the art, optimizes the construction of a roller bearing so that an automatic adjustment of rotational members is achieved for universal applications of the device.

With the foregoing and other objects in view, there is provided, in accordance with the invention, in a printing unit of a rotary printing press, a device for receiving therein a prestressed roller journal, comprising a screw-in element having a prestressed pressure element movably guided therein for adjusting to a contact width of a roller, a bearing member carrying the screw-in element and being adjustable between a vertical installation position thereof and at least one installation position deviating from the vertical installation position, the bearing member being formed with a pair of guide cams disposed opposite one another for automatically orienting the roller in the vertical installation position, one of the guide cams of the pair thereof being disposed so as to carry the dead weight of the roller in the at least one installation position of the bearing member deviating from the vertical installation position.

An advantage of this construction is that an adjustment or justification of rotational members, i.e., the rollers or cylinders, is no longer dependent upon measurements made by the pressman or other operating personnel, but rather, is provided automatically by a pressure element and a screw-in element, after installation of the rotational member. Subjective adjustment errors, which can cause damage to roller coverings or coatings, due to fulling, i.e., pressing or squeezing action, when the press has heated up after operating for a very long time, are consequently eliminated. The roller can be secured reliably with only one tool; checking or counter-tightening can be dispensed with. Temperature variations in the inking unit and differences in stress resulting therefrom can then be compensated for or equalized by a relative movement between the pressure element and the screw-in element, the roller contact width remaining largely preserved.

In accordance with another feature of the invention, the screw-in element is displaceable in the bearing member to a predetermined fixed position. Thereby, on the one hand, adjustment errors by the pressman are avoided and, on the other hand, checking or counter-tightening can be dispensed with. The amount of make-ready or change-over time required for adjustment or justification is drastically reduced.

In accordance with a further feature of the invention, the bearing member is disposable in a selectively oriented installation position at a plurality of locations in the printing unit, at least one of the locations being in an inking unit. Universal applicability of the device for receiving a roller journal, in accordance with the invention, and avoidance of costly matching constructions are afforded thereby. Furthermore, the bearing member is formed with guide cams. Accordingly, in the course of performing an adjustment or justification, wherein the net or dead weight of the roller is supposed to be eliminated, the weight of the roller is absorbed by the respective lower guide cam. It can thus be placed, for example, precisely between two distributor rollers by the contact force exerted by the pressure element.

In accordance with an added feature of the invention, each of the guide cams of the pair thereof is formed with a respective inner surface spaced from one another a distance greater than the diameter of the roller journal to be received by the device. Thus, in a disengagement or shut-off movement, perhaps of the applicator rollers, it is possible, in an advantageous manner, that the received roller may be laterally shifted. In a suitable installation position, the received roller may thus be oriented exactly between the distributor rollers.

In accordance with an additional feature of the invention, the pressure element and the screw-in element define a hollow space therebetween, and compression spring means are received in the hollow space. The compression spring means, i.e., the component generating the contact force, can be constructed as a helical spring or as a spring package or pile; also, the use of a cup spring is also conceivable. The adjustment or matching of the contact forces is effected by the use of compression springs having different spring characteristics or by changing the installation space for the compression spring either by using a modified pressure element or by installing a modified screw-in element. Depending upon the type of installation, the contact forces between the rollers at predetermined installation locations in the inking unit can be matched by the installation of suitably constructed and re-assembled devices for receiving the rollers, in accordance with the invention. Time-consuming adjustment or justification when the rollers are installed or inserted by the pressman is avoided. Due to the uniform construction of the device for receiving roller journals, in accordance with the invention, at various installation locations in the inking unit and the printing unit, respectively, the pressman becomes accustomed rapidly to the by-pass afforded by the device according to the invention, which requires only one tool for its operation.

Thus, in accordance with yet another feature of the invention, the device includes at least another compression spring means having a spring force different from that of the first-mentioned compression spring means, all of the compression spring means being interchangeable for matching contact forces between the pressure element and the roller journal.

In accordance with yet a further feature of the invention, the device includes means for varying the geometry of the hollow space so as to match contact forces between the pressure element and the roller journal.

In accordance with yet an added feature of the invention, the geometry varying means include additional pressure elements respectively having a total length like that of one another and of the first-mentioned pressure element and being mutually interchangeable, each of all of the pressure elements having at least one respectively shortened and lengthened neck and head region, respectively, so as to differ from the others.

In accordance with a concomitant feature of the invention, the geometry varying means include additional screw-in elements respectively having a length differing from one another and from the length of the first-mentioned screw-in element, all of the screw-in elements being selectively interchangeable for varying the geometry of the hollow space.

Other features which are considered as characteristic for the invention are set forth in the appended claims.

Although the invention is illustrated and described herein as embodied in a device for receiving rollers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENT

Figure 1:
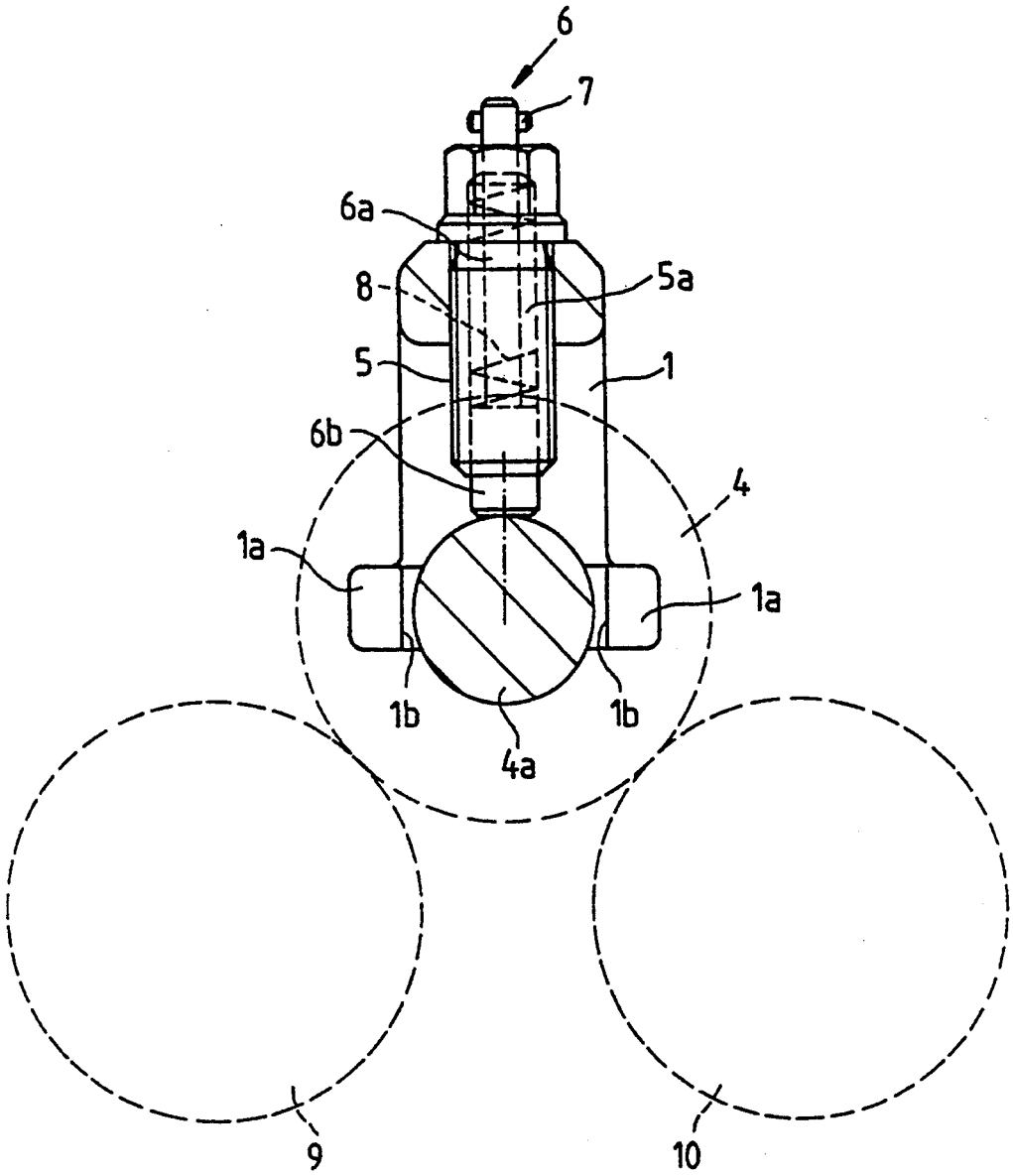
FIG. 1 is a diagrammatic side elevational view of a bearing member of a roller receiving device according to the invention, which is disposed in a vertical installation position.

Referring now to the drawing and, first, particularly to FIG. 1 thereof, there is shown therein a device for receiving rotational members, such as rollers, in a vertical installation position. The receiving device includes a bearing member 1 which is formed with an internal thread in an upper region thereof, as viewed in FIG. 1, and is provided with two guide cams 1*a* in a lower region thereof. The guide cams 1*a* are formed with respective inner surfaces 1*b* facing towards one another, a journal 4*a* of a roller 4 being disposed therebetween. In the embodiment illustrated in FIG. 1, outer cylindrical surfaces of a pair of distributor rollers 9 and 10 serve as guide surfaces for the roller 4.

A screw-in element 5 formed with an interior hollow space 5*a* is threadedly inserted into the internal thread formed in the upper region of the bearing member 1. A pressure element 6 is displaceably disposed in the hollow space 5*a*. The pressure element 6 has a slender throat region 6*a* adjacent a head region 6*b* of increased diameter. The pressure element 6 is secured against falling out of the hollow space 5*a* by a locking pin 7. A compression spring 8 is braced at one end thereof against an upper end wall of the screw-in element 5 partly defining the hollow space 5*a* and, at the opposite end thereof, engages the head region 6*b* of the pressure element 6. The geometry of the hollow chamber 5*a* can be varied by providing that the pressure element 6 be of like total length having a shortened or lengthened head region 6*b*, so that a variation of the contact forces is achievable. This applies as well, obviously, to embodiments of the screw-in element 5 having a shortened or lengthened hollow space 5*a*.

The screw-in element 5 is formed, at the upper end thereof, with an internally-threaded hexagonal nut which, during assembly in the bearing member 1, is tightly screwed against a shoulder or collar formed on the bearing member, thereby dispensing with a locknut or counter-nut. The journal 4*a* of the roller 4 disposed between the inner surfaces 1*b* of the guide cams 1*a* is positioned with defined prestressing and defined width of roller contact between the distributor rollers 9 and 10. Due to the spacing intermediate the inner surfaces 1*b* of the guide cams 1*a*, which spacing exceeds the diameter of the roller journal 4*a*, the roller 4 is able to follow a possible stopping movement.

Figure 2:
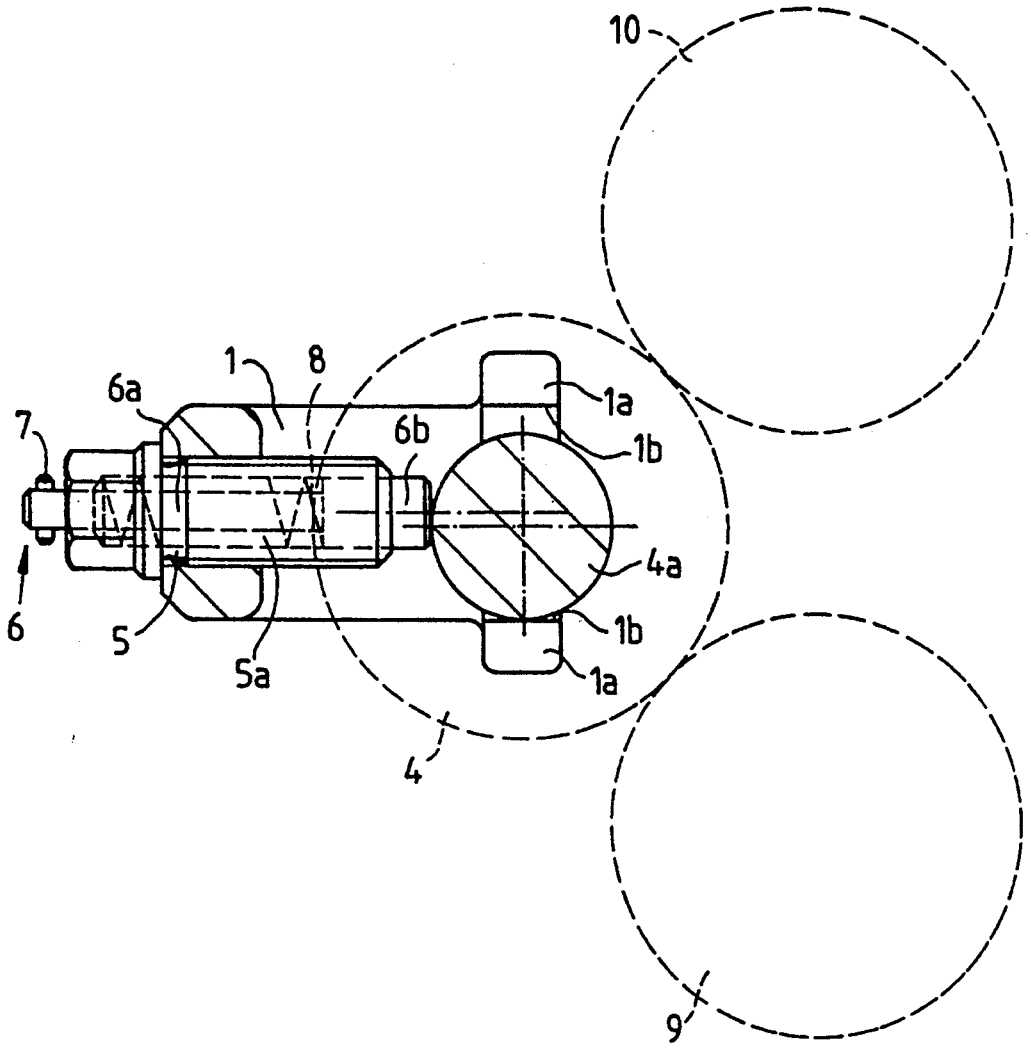
FIG. 2 is a diagrammatic side elevational view of the bearing member disposed in a horizontal installation position.

In FIG. 2, the bearing member 1 is represented in a horizontal installation position thereof. The dead weight of the roller 4 is carried by the lower of the two guide cams 1*a* shown in FIG. 2.

The width of roller contact is again determined by the compression spring 8 acting upon the head region 6*b* of the pressure element 6. To remove the roller 4, it is necessary only that the screw-in elements 5 in the bearing member 1 be turned back far enough until the roller journal 4*a* is able to be guided through the space between both the guide cams 1*a* and the pressure element 6*b*.

For the purpose of shielding or encasing the hollow spaces 5*a* of the respective screw-in elements 5 against a possible ingress of ink residue or agressive solvent and cleaner or wash, the hollow spaces 5*a* can be filled with grease. Accordingly, the inventive device for receiving rollers 4 is considered to be maintenance-free.

Figure 3:
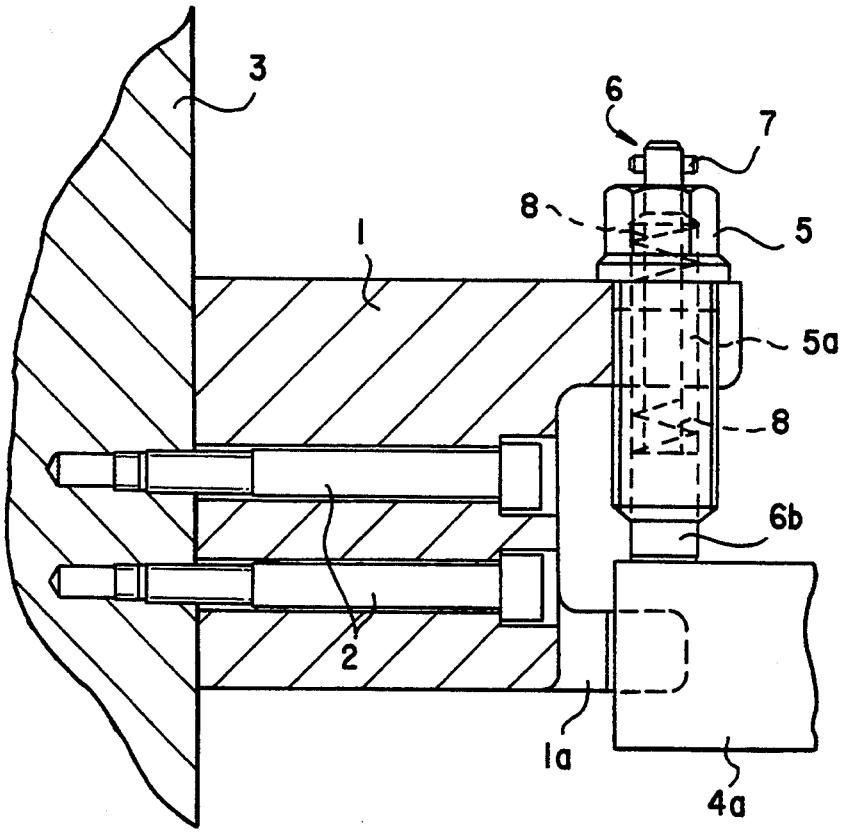
FIG. 3 is a partly sectional, diagrammatic top-plan view of the bearing member secured by threaded bolts in a side wall.

FIG. 3 is a top-plan view of the device for receiving rollers, in accordance with the invention. The bearing member 1 is connected by bolts 2 to a side wall 3, respective heads of the bolts 2 being received in countersunk bores formed in the bearing member 1. It is also possible, however, for the bearing member 1 to be installed into the press in a position wherein it is inclined at a specific angle to the vertical. With the aid of the bearing configuration, both transfer rollers as well as dampening rollers can be received simply and reliably in a printing unit of a printing press. To adjust the spacing between the inner surfaces 1*b* of the guide cams 1*a*, the latter could also be adjusted to larger diameters of roller journals 4*a*, for example, via threaded spindles.

The relatively simple construction, as well as the rapid assembly of the device according to the invention permits a multiplicitous universal application of the device for receiving rollers in accordance with the invention, both at the conventional drive and operating sides of a processing machine, such as a printing press.

The universal applicability or utility of the roller receiving device according to the invention is promoted by the symmetrical construction of the bearing member. Good accessibility and relatively easy operability and utility on the drive and operating sides are provided thereby.

By utilizing a like bearing member 1 as a base member, the use of only one bearing configuration instead of many costly accommodating or matching constructions is afforded. Because the bearing configuration according to the invention is formed of only a few components, manufacturing costs are very low; furthermore, it is possible to use only the bearing according to the invention as the bearing for transfer rollers for each printing unit and inking unit, respectively. This serves to standardize, as well as to minimize make-ready or setting time periods during justification or adjustment of the rollers. Expansions of components occurring during lengthy press operating periods due to warming, i.e., increases in temperature, can be compensated for automatically, for example, by a reduction in fulling, i.e., pressing or squeezing, work in the roller contact zones, and by reducing the bracing of the components, so that the lifespan of the components can be increased considerably.

We claim:

1. In a printing unit of a rotary printing press, a device for receiving therein a roller journal of a printing unit roller, wherein the printing unit roller is disposed substantially parallel with regard to two other rollers of the printing unit and wherein a peripheral surface of the printing unit roller is in contact with respective guide surfaces of the two other rollers, the device comprising a screw-in element having a prestressed pressure element movably guided therein for adjusting to a contact width of a roller, a bearing member carrying said screw-in element, means for allowing said bearing member to be positioned between a vertical installation position thereof and at least one installation position deviating from said vertical installation position, said bearing member being formed with a pair of guide cams symmetrically disposed opposite one another, said guide cams being formed with respective inner surfaces facing one another and being spaced from one another a distance greater than a diameter of the roller journal to be received therebetween and being spaced apart from said pressure element, said guide cams being means for automatically orienting the roller in said vertical installation position, and one of the guide cams of said pair thereof being disposed so as to carry the weight of the roller in said at least one installation position of said bearing member deviating from said vertical installation position.

2. Device according to claim 1, wherein said screw-in element is displaceable in said bearing member to a predetermined fixed position.

3. Device according to claim 1, wherein said bearing member is disposable in a selectively oriented installation position at a plurality of locations in the printing unit.

4. Device according to claim 3, wherein at least one of said locations is in an inking unit.

5. Device according to claim 1, wherein said pressure element and said screw-in element define a hollow space therebetween, and including compression spring means received in said hollow space.

6. Device according to claim 5, wherein said compression spring means has a given spring force defining a contact force between said pressure element and the roller journal.

7. Device according to claim 1, wherein said pressure element and said screw-in element define a hollow space therebetween, and a geometry of said hollow space is preselected so as to define contact forces between said pressure element and the roller journal.

8. Device according to claim 7, wherein said pressure element has predeterminedly shortened and lengthened neck and head regions, respectively, so as to define contact forces between said pressure element and the roller journal.

9. Device according to claim 7, wherein the geometry of said hollow space is predetermined by selecting a given length of said hollow space in said screw-in element.

10. In a printing unit of a rotary printing press, a device for receiving therein a roller journal of printing unit roller, wherein the printing unit roller is disposed substantially parallel with regard to at least two other rollers of the printing unit and the at least two other rollers and the receiving device are disposed in a substantially triangular configuration relative to one another, the device comprising:

a bearing member for supporting the roller journal and for biasing the printing unit roller against the at least two other rollers, said bearing member comprising a screw-in element having a prestressed pressure element movably guided therein for adjusting to a contact width of a roller, means for allowing said bearing member to be positioned in a vertical installation position in which said bearing member extends substantially vertically and a horizontal installation position in which said bearing member extends substantially horizontally;

said bearing member being formed with two guide cams symmetrically disposed opposite one another, said guide cams being formed with respective inner surfaces facing one another and being spaced from one another a distance greater than a diameter of the roller journal to be received therebetween and being spaced apart from said pressure element;

said prestressed pressure element biasing the printing unit roller against the at least two other rollers in said vertical installation position, and one of said guide cams being disposed so as to carry the weight of the roller in said horizontal installation position.

* * * * *